US007648744B2

(12) United States Patent
Kuo et al.

(10) Patent No.: US 7,648,744 B2
(45) Date of Patent: Jan. 19, 2010

(54) TAMPER-INDICATING PRINTABLE SHEET FOR SECURING DOCUMENTS OF VALUE AND METHODS OF MAKING THE SAME

(75) Inventors: Richard J. Kuo, St. Paul, MN (US); Mathias Detjen, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 367 days.

(21) Appl. No.: 10/913,850

(22) Filed: Aug. 6, 2004

(65) Prior Publication Data

US 2006/0029753 A1 Feb. 9, 2006

(51) Int. Cl.
*B41M 5/00* (2006.01)

(52) U.S. Cl. ..... 428/32.13; 428/32.15; 428/32.34; 428/32.36; 428/40.1; 428/41.8; 428/325; 428/352; 428/916; 428/206; 428/207

(58) Field of Classification Search ..... 428/32.13, 428/32.34, 206, 207, 352, 916, 32.15, 32.36, 428/40.1, 41.8, 325
See application file for complete search history.

(56) References Cited

U.S. PATENT DOCUMENTS

| | | | |
|---|---|---|---|
| 2,354,048 | A | 7/1944 | Palmquist |
| 3,700,305 | A | 10/1972 | Bingham |
| 3,752,774 | A | 8/1973 | Stiles |
| 3,758,192 | A | 9/1973 | Bingham |
| 3,770,439 | A | 11/1973 | Taylor |
| 3,801,183 | A | 4/1974 | Sevelin et al. |
| 3,877,786 | A | 4/1975 | Booras et al. |
| 4,153,412 | A | 5/1979 | Bailey |
| 4,605,592 | A | 8/1986 | Paquette et al. |
| 4,688,894 | A | 8/1987 | Hockert |
| 4,775,594 | A | 10/1988 | Desjarlais |
| 5,045,386 | A | 9/1991 | Stan et al. |
| 5,126,195 | A | 6/1992 | Light |
| 5,141,790 | A | 8/1992 | Calhoun et al. |
| 5,169,707 | A | 12/1992 | Faykish et al. |
| 5,198,306 | A | 3/1993 | Kruse |
| 5,656,378 | A | 8/1997 | Lambert |
| 5,766,398 | A | 6/1998 | Cahill et al. |
| 5,916,673 | A | 6/1999 | Fryberg et al. |
| 5,942,335 | A | 8/1999 | Chen et al. |

(Continued)

FOREIGN PATENT DOCUMENTS

| | | |
|---|---|---|
| DE | 38 13 301 | 11/1989 |

(Continued)

OTHER PUBLICATIONS

U.S. Application entitled "Improved Porous Inkjet Receptor Media," Schulz et al., filed Jun. 9, 2000, having U.S. Appl. No. 09/591,075.

*Primary Examiner*—Betelhem Shewareged
(74) *Attorney, Agent, or Firm*—Jeffrey M. Olofson

(57) ABSTRACT

A tamper-indicating printable sheet. A preferred embodiment of the invention provides a tamper-indicating printable sheet comprising a retroreflective layer comprising a plurality of microbeads partially embedded in an inkjet receptive beadbond layer; and a reflector layer between one of the microbeads and the inkjet receptive beadbond layer. The present invention provides a method of making a tamper-indicating printable sheet.

14 Claims, 3 Drawing Sheets

U.S. PATENT DOCUMENTS

| | | | | |
|---|---|---|---|---|
| 6,045,894 | A | 4/2000 | Jonza et al. | |
| 6,060,157 | A * | 5/2000 | LaPerre et al. | 428/325 |
| 6,190,757 | B1 | 2/2001 | Nelson et al. | |
| 6,288,842 | B1 | 9/2001 | Florczak et al. | |
| 6,357,871 | B1 | 3/2002 | Ashida et al. | |
| 6,386,699 | B1 | 5/2002 | Ylitalo et al. | |
| 6,500,527 | B2 | 12/2002 | Miller | |
| 6,548,164 | B1 | 4/2003 | Bacon, Jr. | |
| 6,649,249 | B1 | 11/2003 | Engle et al. | |
| 6,696,951 | B2 | 2/2004 | Belka et al. | |
| 6,720,043 | B1 | 4/2004 | Sismondi et al. | |
| 6,979,480 | B1 | 12/2005 | Schulz et al. | |
| 2003/0170425 | A1 | 9/2003 | Mann et al. | |
| 2003/0184636 | A1 | 10/2003 | Graham et al. | |
| 2003/0219552 | A1 | 11/2003 | Graham et al. | |
| 2003/0235677 | A1 | 12/2003 | Hanschen et al. | |
| 2003/0235678 | A1 | 12/2003 | Graham et al. | |
| 2004/0262909 | A1 | 12/2004 | Bauer et al. | |

FOREIGN PATENT DOCUMENTS

| | | |
|---|---|---|
| EP | 0 655 346 | 5/1995 |
| EP | 0 570 515 B1 | 6/1996 |
| EP | 0 968 836 | 1/2000 |
| EP | 1 008 457 | 6/2000 |
| EP | 1 016 546 | 7/2000 |
| JP | 63183874 | 7/1988 |
| WO | WO 92/13924 | 8/1992 |
| WO | WO 99/10184 | 3/1999 |
| WO | WO 00/73082 | 12/2000 |
| WO | WO 03/070483 | 8/2003 |

* cited by examiner

TAMPER-INDICATING PRINTABLE SHEET FOR SECURING DOCUMENTS OF VALUE AND METHODS OF MAKING THE SAME

TECHNICAL FIELD

The present invention relates to a printable sheet for securing documents of value that is capable of indicating tampering. The present invention relates more particularly to a printable sheet including a retroreflective layer comprising a plurality of microbeads partially embedded in an inkjet receptive beadbond layer and a reflector layer between at least one of the microbeads and the inkjet receptive beadbond layer. The present invention also relates to a method of making a tamper-indicating printable sheet.

BACKGROUND OF THE INVENTION

Documents of value such as passports, identification cards, entry passes, ownership certificates, financial instruments, and the like, are often assigned to a particular person by personalization data. Personalization data, often present as printed images, can include photographs, signatures, fingerprints, personal alphanumeric information, and barcodes, and allows human or electronic verification that the person presenting the document for inspection is the person to whom the document is assigned. There is widespread concern that forgery techniques can be used to alter the personalization data on such a document, thus allowing non-authorized people to pass the inspection step and use the document in a fraudulent manner.

A number of security features have been developed to help authenticate the document of value, thus assisting in preventing counterfeiters from altering, duplicating or simulating a document of value. Some of these security features may include overt security features or covert security features. Overt security features are features that are easily viewable to the unaided eye, such features may include holograms and other diffractive optically variable images, embossed images, and color-shifting films. In contrast, covert security features include images only visible under certain conditions, such as inspection under light of a certain wavelength, polarized light, or retroreflected light. One example of a laminate that includes both overt and covert security features is 3M™ Confirm™ Security Laminate, which is commercially available from 3M Company based in St. Paul, Minn. This security laminate may be used with documents of value, such as identification cards, badges and driver licenses, and assists in providing identification, authentication and to help protect against counterfeiting, alteration, duplication, and simulation. Another example of a laminate that includes both overt and covert security features is illustrated in U.S. Pat. Publication No. 2003/0170425 A1 "Security Laminate," (Mann et al.) Examples of some other devices are taught in U.S. Pat. Nos. 3,801,183 and 4,688,894.

Although the commercial success of available security features has been impressive, as the capabilities of counterfeiters continue to evolve, it is desirable to further improve the ability to indicate that a security feature has been tampered with or somehow compromised to help protect against counterfeiting, alteration, duplication, and simulation.

SUMMARY OF THE INVENTION

One aspect of the present invention provides a tamper-indicating printable sheet. The tamper-indicating printable sheet comprises: a retroreflective layer comprising a plurality of microbeads partially embedded in an inkjet receptive beadbond layer; and a reflector layer between at least one of the microbeads and the inkjet receptive beadbond layer. In one preferred embodiment of the above tamper-indicating printable sheet, the tamper-indicating printable further comprises a covert indicia between the reflector layer and the microbead. In another aspect of this embodiment, the covert image includes a printed symbol, word, logo, or any combination thereof.

In another preferred embodiment of the above tamper-indicating printable sheet, the tamper-indicating printable further comprises an image printed on the inkjet receptive beadbond layer. In another aspect of this embodiment, after a portion of the printed image is removed from the inkjet receptive beadbond layer, a plurality of retroreflective microbeads detach from the portion of the retroreflective layer to indicate tampering. In yet another aspect of this embodiment, the portion of the printed image is removed by image removing liquids. In another aspect of this embodiment, the printed image comprises inkjet ink. In yet another aspect of this embodiment, the printed image includes a printed image of a human face, signature, fingerprint, alphanumeric information, a barcode, or any combination thereof.

In another preferred embodiment of the above tamper-indicating printable sheet, the tamper-indicating printable further comprises a layer of adhesive attached to the inkjet receptive beadbond layer. In another aspect of this embodiment, the tamper-indicating printable sheet further comprises a liner attached to the layer of adhesive. In another aspect of this embodiment, the tamper-indicating printable sheet further comprises a security indicia viewable under retroreflective light conditions. In another aspect of this embodiment, the tamper-indicating printable sheet further comprises an overt indicia on the inkjet receptive beadbond layer. In another aspect of this embodiment, the overt image includes a printed image of a human face, signature, fingerprint, alphanumeric information, a barcode, or any combination thereof.

In another preferred embodiment of the above tamper-indicating printable sheet, a plurality of microbeads detach from the inkjet receptive beadbond layer after image removing liquids are applied to the inkjet receptive layer and tampering is thereby indicated.

Another aspect of the present invention provides a security document comprising in combination: an embodiment of the tamper-indicating printable sheet; and a document of value, where the printable sheet is inserted or attached to the document of value. In another aspect of this embodiment, the document of value is a passport, identification card, financial document, entry pass, ownership certificate, a VISA, birth certificate, resident authorization or any other security or identification-related document.

Another aspect of the present invention provides an alternative tamper-indicating printable sheet. This tamper-indicating printable sheet comprises: a retroreflective layer comprising a plurality of microbeads partially embedded in an inkjet receptive beadbond layer; a reflector layer between at least one of the microbeads and the inkjet receptive beadbond layer; and a printed image on the inkjet receptive beadbond layer; where after a portion of the printed image is removed from the inkjet receptive beadbond layer, a plurality of retroreflective microbeads detach from the portion of the inkjet receptive beadbond layer to indicate tampering. In another aspect of this embodiment, the tamper-indicating printable sheet further comprises a covert indicia between the reflector layer and the microbead. In yet another aspect of this embodiment, the covert image includes a printed symbol, word, logo, or any combination thereof. In another aspect of this embodiment, the portion of the printed image is removed by image removing liquids.

In another preferred embodiment of the above tamper-indicating printable sheet, the printed image comprises inkjet ink. In another preferred embodiment of the above tamper-indicating printable sheet, the printed image includes a printed image of a human face, signature, fingerprint, alphanumeric information, a barcode, or any combination thereof. In yet another preferred embodiment of the above tamper-indicating printable sheet, the tamper-indicating printable sheet of further comprising a layer of adhesive attached to the inkjet beadbond layer. In another aspect of this embodiment, the tamper-indicating printable sheet further comprises a liner attached to the layer of adhesive.

In yet another preferred embodiment of the above tamper-indicating printable sheet, the tamper-indicating printable sheet further comprises a security indicia viewable under retroreflective light. In another preferred embodiment of the above tamper-indicating printable sheet, the tamper-indicating printable sheet further comprises an overt indicia on the inkjet receptive beadbond layer. In another aspect of this embodiment, the overt image includes a printed image of a human face, signature, fingerprint, alphanumeric information, a barcode, or any combination thereof. In yet another preferred embodiment of the above tamper-indicating printable sheet, a plurality of microbeads detach from the inkjet receptive beadbond layer after image removing liquids are applied to the inkjet receptive beadbond layer and tampering is thereby indicated.

Another aspect of the present invention provides a security document comprising in combination: an embodiment of the tamper-indicating printable sheet; and a document of value, where the printable sheet is inserted or attached to the document of value. In another aspect of this embodiment, the document of value is a passport, identification card, financial document, entry pass, ownership certificate, a VISA, birth certificate, resident authorization or any other security or identification-related document.

Another aspect of the present invention provided yet another alternative tamper-indicating printable sheet. This tamper-indicating printable sheet, comprises: a retroreflective layer comprising a plurality of microbeads partially embedded in an inkjet receptive beadbond layer, where the inkjet receptive beadbond layer is formulated such that it indicates tampering; and a reflector layer between at least one of the microbeads and the inkjet receptive beadbond layer.

In another preferred embodiment of the above tamper-indicating printable sheet, the tamper-indicating printable sheet, further comprises a covert indicia between the reflector layer and the microbead. In another preferred embodiment of the above tamper-indicating printable sheet, the covert image includes a symbol, word, logo, or any combination thereof. In another aspect of this embodiment, the tamper-indicating printable sheet further comprises an image printed on the inkjet receptive beadbond layer. In another aspect of this embodiment, after a portion of the printed image is removed from the inkjet receptive beadbond layer, a plurality of retroreflective microbeads detach from the portion of the retroreflective layer to indicate tampering. In yet another aspect of this embodiment, the printed image comprises inkjet ink. In another aspect of this embodiment, the printed image includes a printed image of a human face, signature, fingerprint, alphanumeric information, a barcode, or any combination thereof.

In another preferred embodiment of the above tamper-indicating printable sheet, the tamper-indicating printable sheet further comprises a layer of adhesive attached to the inkjet receptive beadbond layer. In another aspect of this embodiment, the tamper-indicating printable sheet further comprising a liner attached to the layer of adhesive. In another preferred embodiment of the above tamper-indicating printable sheet, the tamper-indicating printable sheet further comprising a security indicia viewable under retroreflective light. In another preferred embodiment of the above tamper-indicating printable sheet, the tamper-indicating printable sheet, further comprising an overt indicia on the inkjet receptive beadbond layer. In another aspect of this embodiment, the overt image includes a printed image of a human face, signature, fingerprint, alphanumeric information, a barcode, or any combination thereof.

In another preferred embodiment of the above tamper-indicating printable sheet, a plurality of microbeads detach from the inkjet receptive beadbond layer after image removing liquids are applied to the inkjet receptive beadbond layer and tampering is thereby indicated.

Another aspect of the present invention provides a security document comprising in combination: an embodiment of the tamper-indicating printable sheet; and a document of value, where the printable sheet is inserted or attached to the document of value. In another aspect of this embodiment, the document of value is a passport, identification card, financial document, entry pass, ownership certificate, a VISA, birth certificate, resident authorization or any other security or identification-related document.

Another aspect of the present invention provides a method of making a tamper-indicating printable sheet. This method comprises the steps of: providing a liner and a plurality of microbeads; partially embedding the plurality of microbeads into the liner; coating a reflector layer on the plurality of microbeads; and coating an inkjet receptive beadbond layer on the reflector layer and plurality of microbeads. In another preferred embodiment of the above method, the method, further includes the step of: printing an image on the inkjet receptive beadbond layer. In another preferred embodiment of the above method, the method further including the steps of: after the partially embedding step, printing a covert indicia on the plurality of microbeads; and where the first coating step includes coating a reflector layer on the covert indicia and plurality of microbeads. In another aspect of this embodiment, the method further including the steps of: removing a portion of the printed image on the retroreflective layer from the inkjet receptive beadbond layer; and detaching a plurality of retroreflective microbeads from the portion of the inkjet receptive beadbond layer to thereby indicate tampering. In another aspect of this embodiment, the printed image is removed from the inkjet receptive beadbond layer image removing liquids. In another preferred embodiment of the above method, the method further includes the step of: printing an overt indicia on the inkjet receptive beadbond layer. In another aspect of this embodiment, the method further including the step of: coating a layer of adhesive on the retroreflective layer. In another preferred embodiment of the above method, the method further including the step of: applying the adhesive to a substrate; and stripping the liner from the plurality of microbead to such that the plurality of microbeads is partially embedded in the inkjet beadbond layer. In another preferred embodiment of the above method, the method further includes the step of: inserting or attaching the tamper-indicating printable sheet to a document of value. In another aspect of this embodiment, where the document of value is a passport, identification card, financial document, entry pass, ownership certificate, a VISA, birth certificate, resident authorization or any other security or identification related document.

Certain terms are used in the description and the claims that, while for the most part are well known, may require some explanation. The term "retroreflective" as used herein refers to the attribute of reflecting an incident light ray in a direction antiparallel to its incident direction, or nearly so, such that it returns to the light source or the immediate vicinity thereof.

As used herein, the term "normal lighting conditions" refers to the presence of ambient light that is substantially diffused, as with light typically used to light a room. The term "retroreflected light conditions" refers to ambient light that is substantially collimated, such as light cast by the headlight of an automobile or by a flashlight, and returns to the light source or the immediate vicinity thereof. The term "unaided eye" means normal (or corrected to normal) human vision not enhanced by, for example, magnification.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
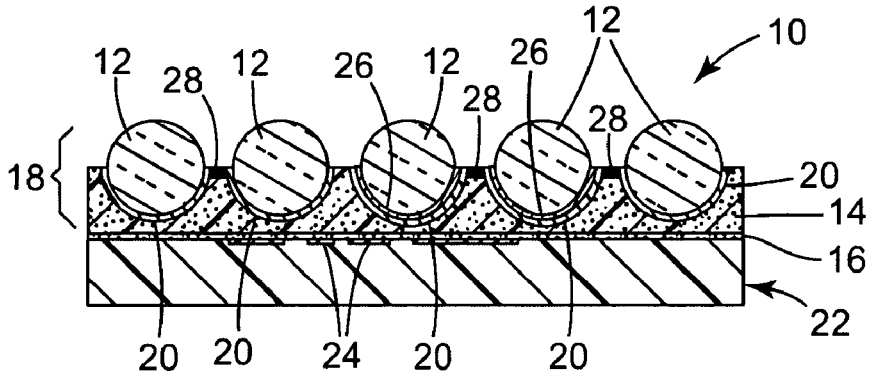
FIG. 1 illustrates a cross-sectional view of one embodiment of the tamper-indicating printable sheet of the present invention.

Many countries have passport offices, which will issue passport booklets to applicants. Typically, a passport includes multiple pages and one of the pages within the passport booklet is printed with personalization information about the specific applicant, such as their picture, full legal name, nationality, date of birth, etc., and certain passport identifying information, such as a machine-readable zone or barcode. After the information is printed, some passport offices will laminate a security film over the printed information to assist in identifying and authenticating the passport. This security film may further help to indicate that the information may have been tampered with at a later date. This lamination process usually requires special equipment using heat and pressure to laminate the security film to the printed passport page. One example of such a security film is commercially available from 3M Company based in St. Paul, Minn. as 3M™ Confirm™ Security Laminate. This security film includes covert images that are visible when viewed with a 3M™ Viewer, which includes a focused light, which assists in identifying and authenticating a valid passport. In addition, if a counterfeiter tries to change the printed information under the laminated security film, the 3M™ Confirm™ security laminate will necessarily be peeled apart to get access to the printed information which results in destroying the film and disrupting the printed information and possibly the covert image, as well, which indicates that tampering has occurred.

Typically, normal passports are issued through a country's central passport processing locations. To request a normal passport, a person will fill out an application and submit their personal information, including a current photograph or a picture taken of them at the processing location. The passport office will then process the application and make a determination whether or not to issue a passport to the applicant based on a variety of factors. This process from application to issuance of the passport can typically take a long time, such as up to four weeks or longer.

However, the passport office may receive requests for emergency or temporary passports by applicants, where the applicant does not have time to wait four weeks or longer to receive the passport. For example, the applicant may have a sick relative in another country, or the applicant may have lost their passport while visiting the country and now needs a new passport to leave the country and return home. Therefore, there is a need to be able to issue these emergency passports very quickly, but yet still provide the security features necessary, such as providing proper identification, authentication, and to indicate whether or not the passport has been tampered with at a later date.

The printable sheet of the present invention may be used to issue emergency or temporary passports to applicants because it may be easily printed and adhered to one of the pages in the emergency or temporary passport booklet by an adhesive, such as a pressure-sensitive adhesive. Thus, the printable sheet does not require the special equipment to laminate it to the passport booklet using heat and pressure. In addition, the printable sheet includes both overt and covert security features (described in more detail below), which assist in identifying and authenticating the passport as a valid passport. Lastly, the printable sheet is constructed so as to clearly indicate if the passport has been tampered with. In other words, if someone has removed the printed information on the sheet and replaced it with new printed information, such as a new name or picture, to create a fake passport, the tamper-indicating sheet of the present invention reveals to an inspector that the passport has been tampered with (described in more detail below), and the inspector may then take appropriate action, which may include stopping the person from either entering or leaving the country. It is possible that the tamper-indicating, printable sheet 10 of the present invention may also be used for issuing normal passports in the future or for other documents of value.

One embodiment of the tamper-indicating, printable sheet 10 of the present invention is illustrated in FIG. 1. The printable sheet 10 includes a plurality of retroreflective glass microbeads 12, preferably with each having a reflector layer 20, partially embedded in and protruding from an inkjet receptive beadbond layer 14. Together, the retroreflective microbeads 12, reflector layers 20 and inkjet receptive beadbond 14 form a retroreflective layer 18. The microbeads 12 may be glass. In one embodiment, the microbeads 12 may range in size of from about 10 to about 200 micrometers. In another embodiment, the glass beads range in size from about 25 micrometers to about 75 micrometers. Such glass microbeads 12 typically have a refractive index of at least about 1.8. Typically, the microbeads 12 of the retroreflective layer 18 are about hemispherically embedded into the inkjet receptive beadbond layer 14. However, the amount of the microbeads 12 embedded into the inkjet receptive beadbond layer 14 may vary from about 25 to about 75% of the microbead diameter. The reflector layer 20 is preferably a transparent, high refractive index material. Examples of useful reflector layer materials include bismuth trioxide, zinc sulfide, titanium dioxide, zirconium oxide, and a stack of zinc sulfide/$Na_3AlF_6$. One example of a suitable reflector layer 20 is a transparent, high refractive index material as described in U.S. Pat. No. 3,801,183, which is hereby incorporated by reference.

Figure 3:
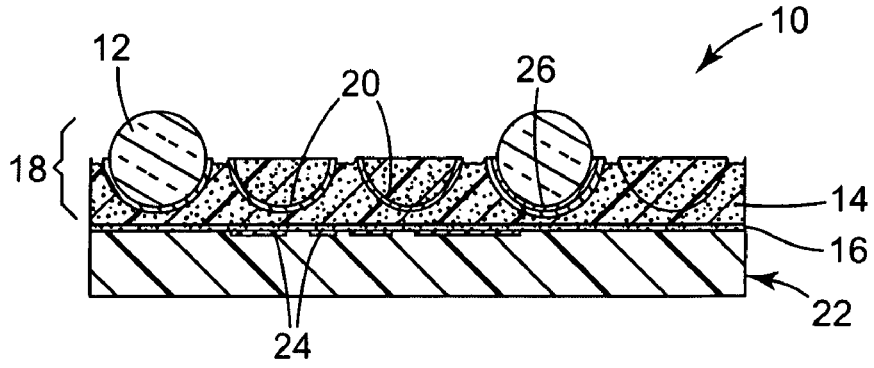
FIG. 3 illustrates the tamper-indicating printable sheet of FIG. 1, where the detachment of the microbeads indicates tampering.
Figure 7:
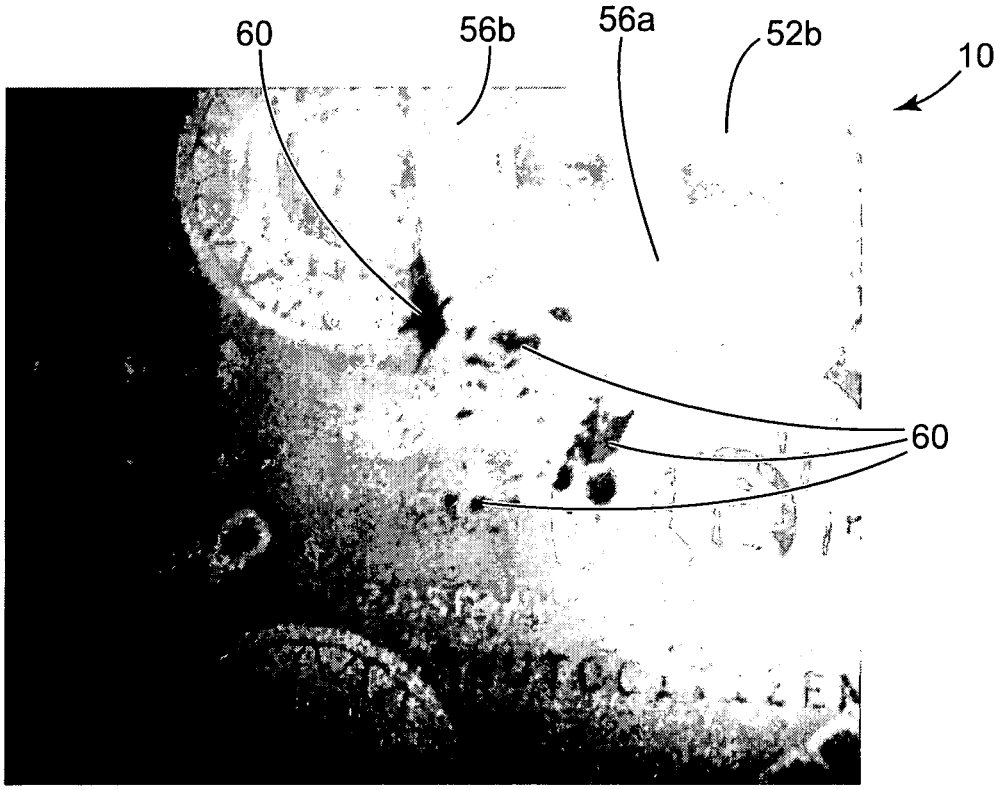
FIG. 7 is a magnified view of the tamper-indicating printable sheet of FIG. 6 under retroreflective lighting conditions.

The inkjet receptive beadbond layer 14 serves at least three purposes. First, inkjet receptive beadbond layer 14 is used to accept images or other information in a discernable or readable form. The ink 28 in the inkjet receptive beadbond layer 14 forms this image and other information. In one embodiment, an image 28 or other information is inkjet printed onto the exposed bead side of printable sheet 10, with the majority of the printed ink retained in the inkjet receptive layer 4. The printable sheets 10 may be imaged using water-based inks, solvent-based inks, and ultra violet light curable inks. Preferably, the printable sheets 10 may be imaged using an inkjet printer and water-based inks. The inks may utilize pigment or dye-based colorants. Second, inkjet receptive beadbond layer 14 securely holds the microbeads 12 in place. Lastly, and quite unexpectedly, the inkjet receptive beadbond layer clearly indicates if the printable sheet has been tampered with after the passport office issued the passport. Specifically, if the printed image 28 is removed by image removing liquids, such as solvents, the printed sheet 10 indicates such tampering by detachment or dislodgement of the microbeads 12 from inkjet receptive beadbond layer 14, as illustrated in FIG. 3. Detachment of the microbeads 12 results in a loss of retroreflectivity displayed by the retroreflective layer 18 in areas in which microbeads are detached and which appear as black areas 60 under retroreflective lighting conditions, which are clearly visible under retroreflective lighting conditions, as illustrated in FIG. 7.

Preferably, the inkjet receptive beadbond layer 14 is water and abrasion resistant. Preferably, the inkjet receptive beadbond layer 14 is transparent.

Useful inkjet receptive beadbond layers 14 include vinylpyrrolidone homopolymers and copolymers and substituted derivatives thereof; vinyl acetate copolymers, for example, copolymers of vinylpyrrolidone and vinyl acetate; polyvinyl alcohol; gelatins and modified gelatins; and the like as disclosed in U.S. Pat. Nos. 5,766,398; 4,775,594; 5,126,195; 5,198,306. Such materials may optionally also include inorganic materials such as alumina and/or silica particles.

In one embodiment, the inkjet receptive beadbond layer 14 comprises polyvinylpyridine and may further include a crosslinker and/or a mordant. Polyvinylpyridines, when at least partially neutralized with an appropriate acid, are water-soluble polymers that can be crosslinked. An exemplary polyvinylpyridine is poly(4-vinylpyridine). The inkjet receptive beadbond layer 14 may contain from greater than 15 to about 100 dry weight percent polyvinylpyridine. In one embodiment, an inkjet receptive beadbond layer 14 of the invention contains at least greater than 15 weight percent polyvinylpyridine on a dry basis. In other embodiments, the inkjet receptive beadbond layer 14 contains at least 20, at least 25, at least 30, or at least 35 weight percent polyvinylpyridine. In other embodiments, the inkjet receptive beadbond layer 14 contains from about 20 to 100, about 30 to 100, about 40 to 100, about 45 to 100, or about 45 to 85 weight percent polyvinylpyridine on a dry basis and any whole or fractional amount between 20 and 100 weight percent.

The inkjet receptive beadbond layer 14 may contain one or more crosslinkers. The crosslinker provides a durable ink receptor by crosslinking the polyvinylpyridine. Useful crosslinkers include, but are not limited to, polyfunctional aziridine compounds (for example, XAMA-2 and XAMA-7, available from Sybron Chemicals, Birmingham, N.J.), polyfunctional epoxy compounds (for example, HELOXY Modifier 48, available from Resolution Performance Products, Houston, Tex., or CR-5L, available from Esprix Digital Imaging Technologies, Sarasota, Fla.), polyfunctional isopropyloxazoline compounds (for example, EPOCROS WS-500, available from Esprix Digital Imaging Technologies, Sarasota, Fla.), and epoxy functional methoxy silane compounds (for example, Z-6040 SILANE, available from Dow Corning, Midland, Mich.).

The inkjet receptive beadbond layer 14 may contain an effective amount of crossslinker to crosslink the polyvinylpyridine so to form a durable and waterfast receptor. The number of crosslinking sites per unit mass of crosslinker typically characterizes the effectiveness of a particular crosslinker. The number of crosslinking sites (also sometimes referred to as "equivalents") refers to the maximum number of bonds that an amount of crosslinker is theoretically able to form with a material to be crosslinked. An equivalent weight refers to the number of grams of crosslinker that contains 1 mole of equivalents or crosslinking sites.

Inkjet receptive beadbond layer 14 may contain from about 0.006 to about 1.5 millimoles crosslinking sites, from about 0.03 to about 0.6 millimoles crosslinking sites, or from about 0.03 to about 0.3 millimoles crosslinking sites per gram of polyvinylpyridine.

The inkjet receptive beadbond layer 14 comprising polyvinylpyridine may contain one or more mordants. A "mordant" as used herein is a material that forms a bond or interaction with dyestuffs in inks. A mordant is used to fix the ink dyestuffs so to provide increased durability to images, particularly water resistance. Exemplary mordants are those materials or compounds that contain cationic moieties, for example, quaternary amino groups. Useful mordants include, but are not limited to, FREETEX 685 (a polyquaternary amine, available from Noveon, Inc., Cleveland, Ohio), DYEFIX 3152 (a ammonium chloride-cyanoguanidine-formaldehyde copolymer, available from Bayer, Pittsburgh, Pa.), GLASCOL F207 (2-Propen-1-aminium, N,N-dimethyl-N-2-propenyl-, chloride, homopolymer, available from Ciba Specialty Chemicals, North America, Tarrytown, N.Y.). The inkjet receptive beadbond layer 14 comprising polyvinylpyridine may contain up to about 70, up to about 60, up to about 50, up to about 40, or up to about 30 dry weight percent mordant and any whole or fractional amount between zero and 70 dry weight percent. In other embodiments, the inkjet receptive beadbond layer 14 may contain from about 40 to about 90 weight percent mordant.

Examples of suitable inkjet receptive beadbond layers 14 includes modified polyurethane resins dispersions commercially available from Esprix Digital Imaging Technologies based in Sarasota, Fla. as inkjet emulsion IJ-100, IJ-130, IJ-140, IJ-150, IJ-170, and IJ-180 under the trade name ESPRIT.

In one embodiment, the tamper-indicating printable sheet 10 may include an overt indicia 24 that is preferably visible through the printable sheet 10 when viewed under normal lighting conditions. In this embodiment, the retroreflective layer 18 is substantially transparent with overt indicia 24 being visible when illuminated under normal lighting conditions. The overt indicia 24 may include a printed image of a human face, signature, fingerprint, alphanumeric information, a barcode, or any combination thereof. The overt indicia 24 may be attached or printed directly to the inkjet receptive beadbond layer 14 opposite the microbeads 12. (not shown) Alternatively, the overt indicia 24 may be attached or printed directly on the substrate 22, which is attached to the printed sheet 10 by a layer of adhesive 16. In this embodiment, the adhesive 16 is preferably transparent to allow the viewer to see the overt indicia 24. Alternatively, the overt indicia 24 may be observed in reverse format on the rear side of the tamper-indicating printable sheet 10.

In another embodiment, the tamper-indicating printable sheet 10 includes another type of overt indicia 28, which the information printed on the inkjet receptive beadbond layer 14 between the microbeads 12. The overt indicia 28 may include variable information, such as the personalization information of the passport holder. For example, the overt indicia 28 may be in the form of a human face, signature, fingerprint, alphanumeric information, a barcode, or any combination thereof. The overt indicia 24 may include fixed information, such as symbols or words representing the country that issued the passport.

In another embodiment, the tamper-indicating printable sheet 10 may include a covert indicia 26 that is preferably visible when the printable sheet 10 is illuminated by, for example, retroreflected light. The covert indicia 26 is located between the reflector layer 20 and the glass microbeads 12. The covert indicia 26 may be included adjacent a portion of the microbeads 12 or adjacent all of the microbeads 12. The different covert indicia 26 under adjacent microbeads 12 may form a printed image of symbol, word, logo, or any combination thereof. The covert indicia 26 is preferably flexographically printed on the microbeads 12 with transparent ink.

The tamper-indicating printable sheet 10 may include any combination and any number of overt indicia 24, 28 and covert indicia 26. For example, the tamper-indicating printable sheet 10 may include an overt indicia 24 in combination with a covert indicia 26. As another example, the tamper-indicating printable sheet 10 may include either an overt indicia 24 or a covert indicia 26. As yet another example, the tamper-indicating printable sheet 10 may include an overt indicia 28 in combination with a covert indicia 26. The tamper-indicating printable sheet 10 may just include an overt indicia 28, or may include an overt indicia 24, a covert indicia 26 and an overt indicia 28.

The tamper-indicating printable sheet 10 is preferably bonded to a substrate 22 by the adhesive 16, as illustrated in FIG. 1. However, the printable sheet 10 may be inserted or otherwise attached to the substrate by other means known to those skilled in the art. The tamper-indicating printable sheet 10 can be used with any document of value such as passports, identification cards, labels, entry passes, ownership certificates, financial instruments, and the like. The document of value may be non-woven or woven. The tamper-indicating printable sheet 10 may be imaged and adhered to a document of value, such as a passport, or imaged, adhered to a backing, and then inserted into a document, as part of the manufacturing process. Alternatively, the tamper-indicating printable sheet 10 may be first attached to or inserted into the document, and then imaged.

Useful adhesives 16 for bonding the tamper-indicating printable sheet 10 to the substrate 22 include pressure sensitive adhesives, heat activated adhesives, ultra violet light curable adhesives, thermosetting adhesives and remoistenable adhesives.

In another embodiment, additional layers of adhesive or substrates may be attached to the substrate 22. For example, a layer of pressure sensitive adhesive and liner may be added to create a self-adhesive label.

Figure 2:
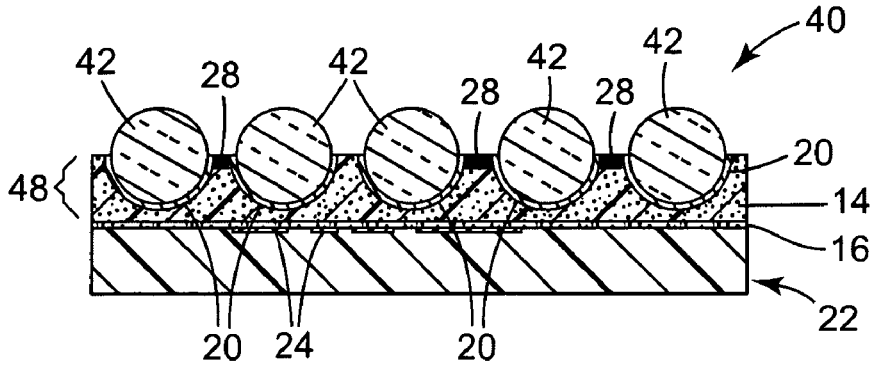
FIG. 2 illustrates a cross-sectional view of another embodiment of the tamper-indicating printable sheet of the present invention.

Another embodiment of the tamper-indicating printable sheet 40 of the invention is shown in FIG. 2. The tamper-indicating printable sheet 40 is exactly the same as the tamper-indicating printable sheet 10 described above in reference to FIG. 1, except that it does not include a covert indicia. In this embodiment, tamper-indicating printable sheet 40 includes a plurality of retroreflective glass microbeads 42 having a reflector layer 20 partially embedded in and protruding from inkjet receptive beadbond layer 14 (together, retroreflective layer 48) and an adhesive layer 16 bonded to the inkjet receptive beadbond layer 14. The tamper-indicating printable sheet 40 also includes a printed image or an overt indicia 28. The tamper-indicating printable sheet 40 is bonded to a substrate 22 which includes an image or overt indicia 24 that is preferably visible through the tamper-indicating printable sheet 40 when viewed under normal lighting conditions. In this embodiment, the retroreflective layer 48 is retroreflective when illuminated with retroreflected light, but no covert security indicia is present on the microbeads 12.

FIG. 3 illustrates what happens to the tamper-indicating printable sheet 10 when it has been tampered with. Specifically, if the printed image 28 is removed through the use of image removing liquids, such as solvents, the printed sheet 10 indicates such tampering by detachment or dislodgement of the microbeads 12 from the inkjet receptive beadbond layer 14. Detachment of the microbeads 12 results in a loss of retroreflectivity displayed by the retroreflective layer 18 and which appears as black areas 60 clearly visible to an inspector under retroreflective lighting conditions, as illustrated in FIG. 7. In addition, the covert indicia 26 may not be viewable to the user, as the covert indicia 26 and/or the reflector layer 20 may also have detached from the inkjet receptive beadbond layer 14. Also, craters left in the inkjet receptive beadbond layer 14 by the detached microbeads 12 may also be visible under normal lighting conditions or with a magnifying glass to indicate tampering. Also, if enough microbeads 12 detach, it may be possible to feel the absence of the beads with your fingertip to detect tampering.

The microbeads 12 will become dislodged or detached from the inkjet receptive beadbond layer 14 upon application of image removing liquids, such as solvents, for a variety of reasons. First, it is believed that the inkjet beadbond layer 14 becomes swollen and as a result, the microbeads 12 are physically detached from the inkjet beadbond layer 14. Second, it is possible that the image removing liquids change the inkjet beadbond layer's bonding or adhesive characteristics, and as a result, the microbeads 12 are physically detached from the inkjet beadbond layer 14. Third, it is also possible that the inkjet receptive beadbond layer 14 is partially dissolved by the image removing liquids, as illustrated in FIG. 3. Regardless of the exact cause, the microbeads 12 detach from the inkjet beadbond layer 14 resulting in an indication that the printable sheet 10 has been tampered with.

Another embodiment of the tamper-indicating printable sheet 10 includes using a sheeting with a composite floating image. (not shown) In this embodiment, the sheeting with a composite floating image is disclosed in U.S. Pat. No. 6,288,842, "Sheeting with Composite Image that Floats" (Florczak et al.), except that the binder layer is replaced with the inkjet receptive beadbond layer taught in the present application. U.S. Pat. No. 6,288,842, "Sheeting with Composite Image that Floats" (Florczak et al.) is hereby incorporated by reference. In this embodiment, when the printed image is removed by image removing liquids, such as solvents, the printable sheet indicates it has been tampered with by the detachment of the microbeads and the loss of retroreflectivity, which is explained in more detail above. In addition, the floating image is also effected or no longer visible and thus, provides an additional indication that the printable sheet has been altered or tampered.

Figure 4:
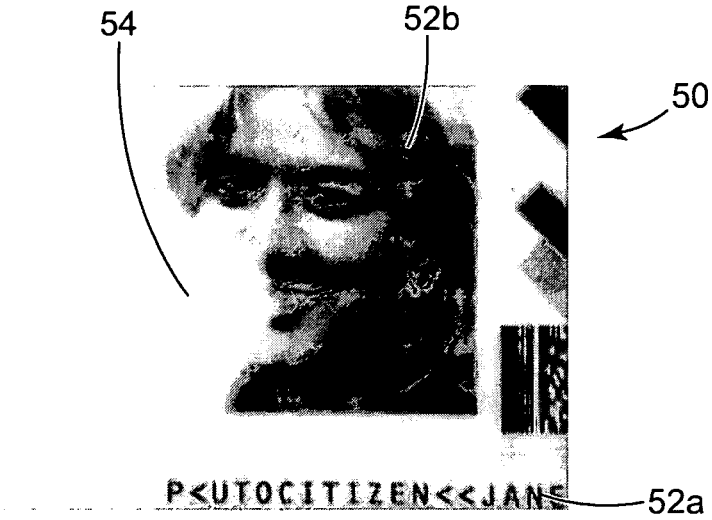
FIG. 4 Prior Art
FIG. 4 is a digitally recorded micrograph of a prior art security laminate with a portion of the printed image removed, as viewed under normal lighting conditions.
Figure 5:
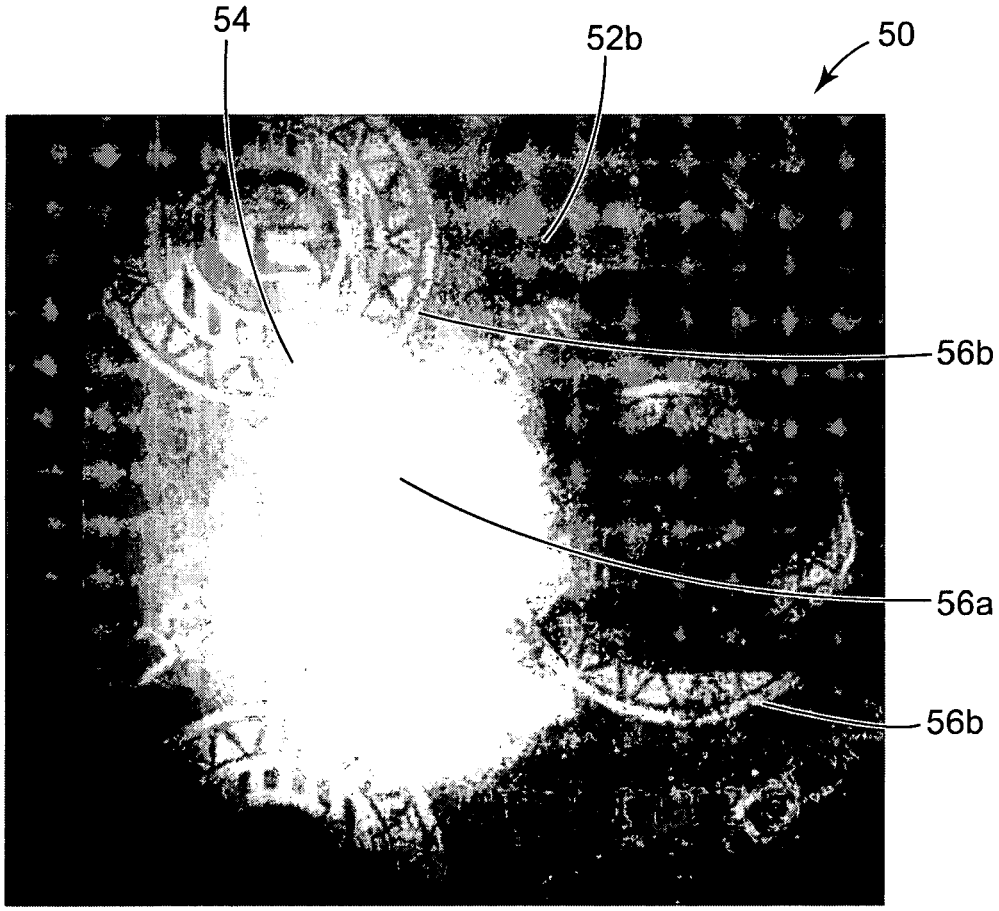
FIG. 5 Prior Art
FIG. 5 is a magnified view of the prior art security laminate of FIG. 4 under retroreflective lighting conditions.

FIGS. 4 and 5 illustrate a prior art security laminate 50 and the results of removing the printed image 52 by an image removing liquid. The prior art security laminate 50 of FIGS. 4 and 5 is the same security laminate that is described in U.S. Pat. Publication No. 2003/0170425 A1 "Security Laminate," (Mann et al.), which is owned by the same assignee as the present application. The prior art security laminate 50 has been printed with water-based ink by an inkjet printer to create a printed image 52 similar to a passport. The image 52 includes a photographic picture of the person owning the passport 52*b* and a machine-readable zone 52*a*. A portion 54 of the photograph 52*b* has been removed by isopropanol. FIG. 4 illustrates the prior art security laminate 50 under normal lighting conditions. FIG. 5 illustrates the same prior art security laminate 50 under retroreflected light conditions, so as to view the covert indicia 56. The prior art security laminate 50 includes two forms of covert indicia, the word "CONFIRM" 56*a* and a seal 56*b*. As illustrated in the portion 54 where the photographic image 52*b* has been removed, the covert indicia 56 is still viewable and there are no signs of tampering. This prior art security laminate will allow a counterfeiter to remove the photographic image from the image receptive material of the prior art security laminate and replace it with a new photographic image to create a counterfeit passport.

Figure 6:
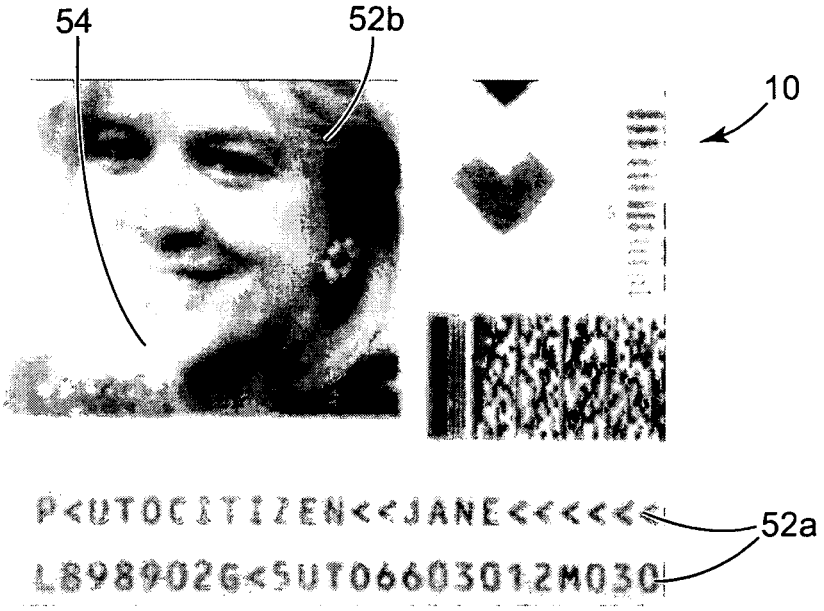
FIG. 6 is digitally recorded micrograph of the tamper-indicating printable sheet of the present invention with a portion of the printed image removed under normal lighting conditions.

In contrast, FIGS. 6 and 7 illustrate the tamper-indicating, printable sheet 10 of the present invention and the results of removing the printed image 52 through the use of an image removing liquid, isopropanol alcohol. Similar to the prior art security laminate 50, the tamper-indicating printable sheet 10 has been printed with water-based ink by an inkjet printer to create a printed image 52 similar to a passport. Similar to FIGS. 4 and 5, the image 52 includes a photographic picture of the person owning the passport 52*b* and a machine-readable zone 52*a*. A portion 54 of the photograph 52*b* has been removed by an image removing liquid, isopropanol alcohol. FIG. 6 illustrates the tamper-indicating printable sheet 10 under normal lighting conditions. FIG. 7 illustrates the same tamper-indicating printable sheet 10 under retroreflected light conditions, so as to view the covert indicia 56. Similar to FIGS. 4 and 5, the tamper-indicating printable sheet 10 includes two forms of covert indicia, the word "CONFIRM" 56*a* and a seal 56*b*. Under normal lighting conditions in FIG. 6, the areas where the photographic image 52*b* has been removed is viewed as white spots. Under retroreflective lighting conditions in FIG. 7, in the portion 54 where the photographic image 52*b* has been removed, portions 60 of the covert indicia 56 are not viewable. Instead, there are clear indications of tampering as evident by the black spots 60 in FIG. 7. These black spots 60 are the areas of the retroreflective layer 18 where the microbeads 12 have dislodged or detached from the inkjet receptive beadbond layer 14. Since the microbeads 12 have detached, there is a loss of retroreflectivity in the tamper-indicating printable sheet 10. In addition, since the covert indicia 26 was flexographically printed on the detached microbeads 12, most likely the covert indicia 26 also detached from the inkjet beadbond layer 14 with the microbeads 12. It is possible that some portion or all of the reflector layers 20 also detached with the microbeads 42. However, it is possible that some portions or all of the reflector layers 20 remain intact. If an inspector at a country boarder inspection point notices these black spots on the printed sheet 10 under retroreflected light conditions, they will immediately know that the printed sheet 10 in the passport has been tampered with, and the inspector can take appropriate action, which may include stopping the person from either entering or leaving the country.

Examples of typical image removing liquids potentially capable of removing the printed image 28 from the inkjet beadbond layer 14 are listed in the Examples below.

One exemplary method of making the tamper-indicating printable sheet 10, 40 is as follows. First, flood coat a monolayer of glass microbeads 12 onto one side of a paper carrier that contains a thin coating of polyolefin. Next, the microbeads 12 and paper carrier are run through an oven at controlled temperature and speed. Due to heat and gravity, the microbeads 12 will partially sink or partially embed themselves into the polyolefin liner. Excess microbeads 12 that are not embedded into the polyolefin layer are removed from the carrier, for example, by a vacuum source. Next, the covert indicia 26 is flexographically printed onto the exposed microbeads 12. Next, the reflector layer 20 is formed by vapor coating a partially light-transmissive, dielectric mirror material over the top of the covert indicia 26 and the microbeads 12. Next, the inkjet receptive beadbond layer 14 is coated onto the vapor-coated microbeads 12. Next, a layer of adhesive is placed between the inkjet receptive beadbond layer 14 and another substrate, such as paper. Next, peel off the paper carrier to reveal the tamper-indicating printable sheets 10, 40 illustrated in FIGS. 1 and 2. Finally, another layer of pressure sensitive adhesive may be coated onto the paper substrate and a liner may be added to the pressure sensitive adhesive. Large sheets of the tamper-indicating printable sheet 10, 40 may be die-cut into desired shapes and sizes and also may be provided in roll form.

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLES

"Confirm ES" is a brand of a printable sheet having glass microbeads in a beadbond, available from 3M Company, St. Paul, Minn.

"REILLINE 420" is a trade designation for a solution of 40% poly(4-vinylpyridine), available from Reilly Industries, Inc., Indianapolis, Ind.

"FREETEX 685" is a trade designation for a cationic polyamine, available from Noveon, Inc., Cleveland, Ohio.

"HELOXY MODIFIER 48" is a trade designation for a polyfunctional epoxy crosslinker, available from Resolution Performance Products, Houston, Tex.

"Isopropanol" is the generic term for a secondary alcohol, available from EMD Chemicals, Inc., Gibbstown, N.J.

"Ethyl alcohol" is the generic term for an unflavored alcohol, available from AAPER Alcohol and Chemical Co., Shelbyville, Ky.

"Acetic acid, glacial" is a pure acetic acid available from Aldrich Chemical Co., Milwaukee, Wis.

Comparative Example 1

This comparative example is based on the disclosure of U.S. Pat. Publication No. 2003/0170425 A1 "Security Laminate," (Mann et al.), which is owned by the same assignee as the present patent application.

The following three compositions were prepared.

Composition A: Prepared by adding 2 parts by weight of glacial acetic acid to 10 parts by weight REILLINE 420, mixing well, then adding 5 parts by weight isopropanol, mixing well, than adding 15 parts by weight de-ionized water.

Composition B: was prepared by mixing 10 parts by weight FREETEX 685 with 38 parts de-ionized water.

Composition C: was prepared by mixing 1 part by weight HELOXY MODIFIER 48 with 15 parts ethyl alcohol.

A piece of CONFIRM ES was placed on top of an approximately 3 mm thick glass plate with the exposed retroreflective bead side of the CONFIRM ES facing away from the plate. A mixture comprising 21 parts by weight of Composition A, 4 parts by weight of Composition B and 1 part by weight of Composition C was prepared. This inkjet receptive coating formulation was coated onto the exposed retroreflective bead side of the CONFIRM ES using a Mayer Rod #4, followed by drying in an oven at approximately 80° C. for approximately 4 minutes, and then allowed to cool to room temperature. This material was then printed with an Epson Stylus C80 inkjet printer using aqueous pigmented inkjet inks (printer and ink cartridges—T032120 black, T032220 cyan, T032320 magenta and T032420 yellow—all available from Epson America, Inc., Long Beach, Calif.). Image quality was evaluated visually with and without a magnifying glass. The printed image was found to have excellent quality as the image had excellent line sharpness with no bleed or feathering between colors. Color densities of black, magenta, yellow, and cyan were measured and the results are summarized in Table 6.

The image removal liquids listed in Table-1 were used to evaluate the coated printed material for resistance of the printed image to tampering and to evaluate the printed material for indications of tampering by rubbing the printed material with Q-tips wetted individually with each liquid. Impact of the image removal liquids upon the printed image of the examples was evaluated. Evaluation of the printed image was limited to either the image was totally removed or not totally removed, since to effective forge a document, a printed image such as the photographic image of the person, must be completely removed in order to replace the original image with a forged image. Assessment of the example materials ability to indicate tampering was evaluated by determining if the microbeads were detached or removed. The results for the Comparative Example 1 is shown in Table-1.

TABLE 1

(COMPARATIVE EXAMPLE 1: INKJET RECEPTIVE COATING ON TOP OF CONFIRM)

| Image Removing Liquids | Total Image Removed | Resistance to Tampering | Beads Removed | Able To Indicate Tampering |
|---|---|---|---|---|
| Isopropanol | Yes | No | No | No |
| Acetone | Yes | No | Yes | Yes |
| Methyl Ethyl Ketone (MEK) | Yes | No | Yes | Yes |

TABLE 1-continued (COMPARATIVE EXAMPLE 1: INKJET RECEPTIVE COATING ON TOP OF CONFIRM)

| Image Removing Liquids | Total Image Removed | Resistance to Tampering | Beads Removed | Able To Indicate Tampering |
|---|---|---|---|---|
| Mineral spirit | No | Yes | No | N/A |
| Toluene | No | Yes | No | N/A |
| Ethylene glycol (50%) | Yes | No | No | No |
| Acetic acid (50%) | Yes | No | No | No |
| Ammonium hydroxide (30%) | No | Yes | No | N/A |
| Bleach | No | Yes | No | N/A |
| Surfynol CT-136 surfactant (2%) | Yes | No | No | No |
| Gasoline (unleaded) | No | Yes | No | N/A |
| Diesel Fuel | No | Yes | No | N/A |

Example 2

Using Compositions A, B and C of Comparative Example 1, a mixture comprising 21 parts by weight of Composition A, 4 parts by weight of Composition B and 1 part by weight of Composition C was prepared. This inkjet receptive coating formulation was substituted for the urethane "beadbond" normally used to secure the retroreflective microbeads in Confirm ES. A tamper-indicating printable sheet of the present invention, using the inkjet receptive coating as a beadbond, was made by coating onto vapor coated glass beads that were partially embedded in the polyethylene film of a paper carrier (polyethylene coated paper) the inkjet receptive coating using a Mayer Rod #4, followed by drying in an oven at approximately 80° C. for approximately 4 minutes, and then allowed to cool to room temperature. Using a 3M Passport CONFIRM Laminator, Model Number 6060P, available from 3M Company, St. Paul, Minn., the tamper-indicating printable sheet was then laminated to a Trans-Kote PET/MR 5/2 PET film coated with hot-melt adhesive available from Transilwrap Company, Inc. Franklin Park, Ill. The paper coated with polyethylene was then peeled off exposing the glass beads.

Inspection of the PET film under microscope revealed that all the glass beads were transferred from the paper carrier and that the beads were partially embedded in the hot-melt adhesive layer. The tamper-indication printable sheet was then printed on the bead side with the Epson Stylus C80 inkjet printer. Image quality was evaluated visually with and without a magnifying glass. The printed image was found to have excellent quality as the image had excellent line sharpness with no bleed or feathering between colors. Color densities of black, magenta, yellow, and cyan were measured and the results are summarized in Table 6.

The same image removing liquids listed in Table-1 were used to evaluate the tamper-indicating printable sheet for resistance of the printed image to tampering and to evaluate the printed material for indications of tampering by rubbing the printed material with Q-tips wetted individually with each liquid. Impact of the image removal liquids upon the printed image of the examples was evaluated. Evaluation of the printed image was limited to either the image was totally removed or not totally removed, since to effective forge a document, a printed image such as the photographic image of the person, must be completely removed in order to replace the original image with a forged image. Assessment of the example materials ability to indicate tampering was evaluated by determining if the microbeads were detached or removed. The results of the evaluations for Example 2 is shown in Table-2.

| Image Removing Liquids | Total Image Removed | Resistance to Tampering | Beads Removed | Indication of Tampering |
|---|---|---|---|---|
| Isopropanol | No | Yes | Yes | Yes |
| Acetone | No | Yes | No | N/A |
| Methyl Ethyl Ketone (MEK) | No | Yes | No | N/A |
| Mineral spirit | No | Yes | No | N/A |
| Toluene | No | Yes | No | N/A |
| Ethylene glycol (50%) | Yes | No | Yes | Yes |
| Acetic acid (50%) | Yes | No | Yes | Yes |
| Ammonium hydroxide (30%) | No | Yes | No | N/A |
| Bleach | No | Yes | No | N/A |
| Surfynol CT-136 surfactant (2%) | No | Yes | No | N/A |
| Gasoline (unleaded) | No | Yes | No | N/A |
| Diesel Fuel | No | Yes | No | N/A |

Example 3

A tamper-indicating printable sheet was made as described in Example 2. For this example, inkjet receptive coating solution IJ-140, obtained from Esprix Digital Imaging Technologies, Sarasota, Fla., was coated onto the vapor coated glass beads using a Mayer Rod #10, followed by drying in an oven at approximately 60° C. for approximately 10 minutes and then allowed to cool to room temperature. Using a Mini-Kote laboratory laminator available from D&K Company, Elk Grove, Ill., the tamper-indicating printable sheet was then laminated to a Trans-Kote PET/MR 7/3 PET film coated hot-melt adhesive available from Transilwrap Company, Inc. Franklin Park, Ill. Lamination was done at a roll temperature of approximately 300° F. and a roll speed of approximately 1.5 ft/min. The paper coated with polyethylene carrier was then peeled off exposing the glass beads.

Inspection of the PET film under microscope revealed that all the glass beads were transferred from the carrier and that the beads were partially embedded in the hot-melt adhesive layer. The tamper indicating printable sheet was then printed on the bead side using an Epson Stylus CX5400 inkjet printer using aqueous pigmented inkjet inks (printer and ink cartridges—T032120 black, T042220 cyan, T042320 magenta and T042420 yellow—all available from Epson America, Inc., Long Beach, Calif.). Image quality was evaluated visually with and without a magnifying glass. The printed image was found to have excellent quality as the image had excellent line sharpness with no bleed or feathering between colors. Color densities of black, magenta, yellow, and cyan were measured and the results are summarized in Table 6.

The same test liquids/solvents listed in Table-1 were used to evaluate the tamper-indicating printable sheet for resistance of the printed image to tampering and to evaluate the printed material for indications of tampering by rubbing the printed material with Q-tips wetted individually with each liquid. Impact of the image removal liquids upon the printed image of the examples was evaluated. Evaluation of the printed image was limited to either the image was totally removed or not totally removed, since to effective forge a document, a printed image such as the photographic image of the person, must be completely removed in order to replace the original image with a forged image. Assessment of the example materials ability to indicate tampering was evaluated by determining if the microbeads were detached or removed. The results of the resistance to tampering evaluation for Example 3 is shown in Table-3.

TABLE 3

| Image Removing Liquids | Total Image Removal | Resistance to Tampering | Beads Removal | Indication of Tampering |
|---|---|---|---|---|
| Isopropanol | Yes | No | Yes | Yes |
| Acetone | Yes | No | Yes | Yes |
| Methyl Ethyl Ketone (MEK) | Yes | No | Yes | Yes |
| Mineral spirit | No | Yes | No | N/A |
| Toluene | No | Yes | No | N/A |
| Ethylene glycol (50%) | Yes | No | Yes | Yes |
| Acetic acid (50%) | Yes | No | Yes | Yes |
| Ammonium hydroxide (30%) | Yes | No | Yes | Yes |
| Bleach | Yes | No | Yes | Yes |
| Surfynol CT-136 surfactant (2%) | No | Yes | No | N/A |
| Gasoline (unleaded) | No | Yes | No | No |
| Diesel Fuel | No | Yes | No | No |

Example 4

A tamper-indicating printable sheet was made as described in Example 2. For this example, inkjet receptive coating solution IJ-150, obtained from Esprix Digital Imaging Technologies, Sarasota, Fla., was coated onto the vapor coated glass beads using a Mayer Rod #10, followed by drying in an oven at approximately 60° C. for approximately 10 minutes and then allowed to cool to room temperature. Using a Mini-Kote laboratory laminator available from D&K Company, Elk Grove, Ill., the tamper-indicating printable sheet was then laminated to a Trans-Kote PET/MR 7/3 PET film coated with hot-melt adhesive available from Transilwrap Company, Inc. Franklin Park, Ill. Lamination was done at a roll temperature of approximately 300° F. and a roll speed of approximately 1.5 ft/min. The paper coated with polyethylene carrier was then peeled off exposing the glass beads.

Inspection of the PET film under microscope revealed that all the glass beads were transferred from the carrier and that the beads were partially embedded in the hot-melt adhesive layer. The tamper-indicating printable sheet was then printed on the bead side using the Epson Stylus CX5400 inkjet printer. Image quality was evaluated visually with and without a magnifying glass. The printed image was found to have excellent quality as the image had excellent line sharpness with no bleed or feathering between colors. Color densities of black, magenta, yellow, and cyan were measured and the results are summarized in Table 6.

The same test liquids/solvents listed in Table-1 were used to evaluate the tamper-indicating printable sheet for resistance of the printed image to tampering and to evaluate the printed material for indications of tampering by rubbing the printed material with Q-tips wetted individually with each liquid. Impact of the image removal liquids upon the printed image of the examples was evaluated. Evaluation of the printed image was limited to either the image was totally removed or not totally removed, since to effective forge a document, a printed image such as the photographic image of the person, must be completely removed in order to replace the original image with a forged image. Assessment of the example materials ability to indicate tampering was evaluated by determining if the microbeads were detached or removed. Results of the resistance to tampering evaluation for Example 4 is shown in Table-4.

TABLE 4

| Image Removing Liquids | Total Image Removal | Resistance to Tampering | Beads Removal | Indication of Tampering |
|---|---|---|---|---|
| Isopropanol | No | Yes | No | N/A |
| Acetone | No | Yes | No | N/A |
| Methyl Ethyl Ketone (MEK) | No | Yes | No | N/A |
| Mineral spirit | No | Yes | No | N/A |
| Toluene | No | Yes | No | N/A |
| Ethylene glycol (50%) | No | Yes | No | N/A |
| Acetic acid (50%) | Yes | No | Yes | Yes |
| Ammonium hydroxide (30%) | Yes | No | Yes | Yes |
| Bleach | No | Yes | No | N/A |
| Surfynol CT-136 surfactant (2%) | No | Yes | No | N/A |
| Gasoline (unleaded) | No | Yes | No | N/A |
| Diesel Fuel | No | Yes | No | N/A |

Example 5

A tamper-indicating printable sheet was made as described in Example 2. For this example, inkjet receptive coating solution IJ-170, obtained from Esprix Digital Imaging Technologies, Sarasota, Fla., was coated onto the vapor coated glass beads using a Mayer Rod #10, followed by drying in an oven at approximately 60° C. for approximately 10 minutes and then allowed to cool to room temperature. Using a Mini-Kote laboratory laminator available from D&K Company, Elk Grove, Ill., the tamper-indicating printable sheet was then laminated to a Trans-Kote PET/MR 7/3 PET film coated with hot-melt adhesive available from Transilwrap Company, Inc. Franklin Park, Ill. Lamination was done at a roll temperature of approximately 300° F. and a roll speed of approximately 1.5 ft/min. The paper coated with polyethylene carrier was then peeled off exposing the glass beads.

Inspection of the PET film under microscope revealed that all the glass beads were transferred from the carrier and that the beads were partially embedded in the hot-melt adhesive layer. The tamper-indicating printable sheet was then printed on the bead side using the Epson Stylus CX5400 inkjet printer. Image quality was evaluated visually with and without a magnifying glass. The printed image was found to have excellent quality as the image had excellent line sharpness with no bleed or feathering between colors. Color densities of black, magenta, yellow, and cyan were measured and the results are summarized in Table 6.

The same test liquids/solvents listed in Table-1 were used to evaluate the tamper-indicating printable sheet for resistance of the printed image to tampering and to evaluate the printed material for indications of tampering by rubbing the printed material with Q-tips wetted individually with each liquid. Impact of the image removal liquids upon the printed image of the examples was evaluated. Evaluation of the printed image was limited to either the image was totally removed or not totally removed, since to effective forge a document, a printed image such as the photographic image of the person, must be completely removed in order to replace the original image with a forged image. Assessment of the example materials ability to indicate tampering was evaluated by determining if the microbeads were detached or removed. The results of the resistance to tampering evaluation for Example 5 is shown in Table-5.

TABLE 5

| Image Removing Liquids | Total Image Removal | Resistance to Tampering | Beads Removal | Indication of Tampering |
|---|---|---|---|---|
| Isopropanol | No | Yes | No | N/A |
| Acetone | No | Yes | No | N/A |
| Methyl Ethyl Ketone (MEK) | No | Yes | No | N/A |
| Mineral spirit | No | Yes | No | N/A |
| Toluene | No | Yes | No | N/A |
| Ethylene glycol (50%) | No | Yes | No | N/A |
| Acetic acid (50%) | Yes | No | Yes | Yes |
| Ammonium hydroxide (30%) | Yes | No | Yes | Yes |
| Bleach | No | Yes | No | N/A |
| Surfynol CT-136 surfactant (2%) | No | Yes | No | N/A |
| Gasoline (unleaded) | No | Yes | No | N/A |
| Diesel Fuel | No | Yes | No | N/A |

TABLE 6

COLOR DENSITIES

| | Comparative Example 1 | Example 2 | Example 3 | Example 4 | Example 5 |
|---|---|---|---|---|---|
| Black | 1.17 | 1.14 | 1.17 | 1.08 | 1.13 |
| Magenta | 0.75 | 0.70 | 0.76 | 0.76 | 0.77 |
| Yellow | 0.75 | 0.78 | 0.95 | 0.87 | 0.95 |
| Cyan | 0.59 | 0.60 | 0.66 | 0.67 | 0.65 |

The tests and test results described above are intended solely to be illustrative, rather than predictive, and variations in the testing procedure can be expected to yield different results.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A tamper-indicating printable sheet, comprising:

a retroreflective layer consisting essentially of:

a plurality of microbeads partially embedded in a tamper-indicating inkjet receptive beadbond layer; and a reflector layer between at least one of the microbeads and the tamper-indicating inkjet receptive beadbond layer.

2. The tamper-indicating printable sheet of claim 1, wherein the retroreflective layer further consists of a covert indicia between the reflector layer and the microbead.

3. The tamper-indicating printable sheet of claim 2, wherein the covert indicia includes a printed symbol, word, logo, or any combination thereof.

4. The tamper-indicating printable sheet of claim 1, further comprising a layer of adhesive attached to the tamper-indicating inkjet receptive beadbond layer.

5. The tamper-indicating printable sheet of claim 4, further comprising a liner attached to the layer of adhesive.

6. The tamper-indicating printable sheet of claim 1, further comprising a security indicia viewable under retroreflective light conditions.

7. A security document, comprising in combination:

the tamper-indicating printable sheet of claim 1; and a document of value, wherein the printable sheet is inserted or attached to the document of value.

8. The security document of claim 7, wherein the document of value is a passport, identification card, financial document, entry pass, ownership certificate, a VISA, birth certificate, resident authorization or any other security or identification-related document.

9. A tamper-indicating printable sheet, comprising:

a retroreflective layer comprising a plurality of microbeads partially embedded in an inkjet receptive beadbond layer, wherein the inkjet receptive beadbond layer is formulated such that it indicates tampering after a solvent is applied to the inkjet receptive beadbond layer; and a reflector layer between at least one of the microbeads and the inkjet receptive beadbond layer.

10. The tamper-indicating printable sheet of claim 9, further comprising a covert indicia between the reflector layer and the microbead.

11. The tamper-indicating printable sheet of claim 10, wherein the covert indicia includes a symbol, word, logo, or any combination thereof.

12. The tamper-indicating printable sheet of claim 9, further comprising a layer of adhesive attached to the inkjet receptive beadbond layer.

13. The tamper-indicating printable sheet of claim 12, further comprising a liner attached to the layer of adhesive.

14. The tamper-indicating printable sheet of claim 9, further comprising a security indicia viewable under retroreflective light.

* * * * *

UNITED STATES PATENT AND TRADEMARK OFFICE

CERTIFICATE OF CORRECTION

PATENT NO. : 7,648,744 B2
APPLICATION NO. : 10/913850
DATED : January 19, 2010
INVENTOR(S) : Richard J. Kuo It is certified that error appears in the above-identified patent and that said Letters Patent is hereby corrected as shown below:

Title Page

Column 1; Inventors
Line 2; delete "(US)" and insert -- (US); Brian W. Dunne, Cambridge Park, New South Wales (US) --, therefor.

Column 8
Line 17; delete "crossslinker" and insert -- crosslinker --, therefor.

Signed and Sealed this

Thirtieth Day of March, 2010

David J. Kappos

David J. Kappos
*Director of the United States Patent and Trademark Office*